US005297345A

United States Patent [19]

Jaakola

[11] Patent Number: 5,297,345

[45] Date of Patent: Mar. 29, 1994

[54] SLICING KNIFE WITH NON-STICK BLADE

[76] Inventor: Kenneth A. Jaakola, 1804 Big Lake Rd., Cloquet, Minn. 55720

[21] Appl. No.: 920,729

[22] Filed: Jul. 28, 1992

[51] Int. Cl.[5] ..... B26B 3/03; B26B 9/00

[52] U.S. Cl. ..... 30/348; 30/351

[58] Field of Search ..... 30/348, 351, 115, 346

[56] References Cited

U.S. PATENT DOCUMENTS

| | | | |
|---|---|---|---|
| 1,489,419 | 4/1924 | Beechlyn | 30/348 |
| 1,997,953 | 4/1935 | Van Der Kuy | 30/351 |
| 2,338,007 | 12/1943 | Morris | 30/351 |

FOREIGN PATENT DOCUMENTS

| | | | |
|---|---|---|---|
| 2918847 | 11/1980 | Fed. Rep. of Germany | 30/115 |
| 1269929 | 4/1972 | United Kingdom | 30/348 |

*Primary Examiner*—Frank T. Yost

*Assistant Examiner*—Rinaldi Rada

*Attorney, Agent, or Firm*—Haugen and Nikolai

[57] ABSTRACT

A slicing knife comprises a handle and a blade extending from one end of the handle where the blade is generally rectangular in shape and has opposed edges honed to a knife edge. Formed into the thickness dimension of the blade are a plurality of zones of reduced thickness which may be longitudinally-spaced apertures which are separated from one another by ribs having a generally rhombic cross-section. The blade tapers from a maximum thickness dimension in each direction in creating the knife edge and in approaching the zones of reduced thickness. The thickness of the ribs exceeds the blade thickness such that when it is pressed, for example, through a block of cheese, the cheese only contacts the blade along the line segments defined by the corners of the rhombic ribs.

4 Claims, 1 Drawing Sheet

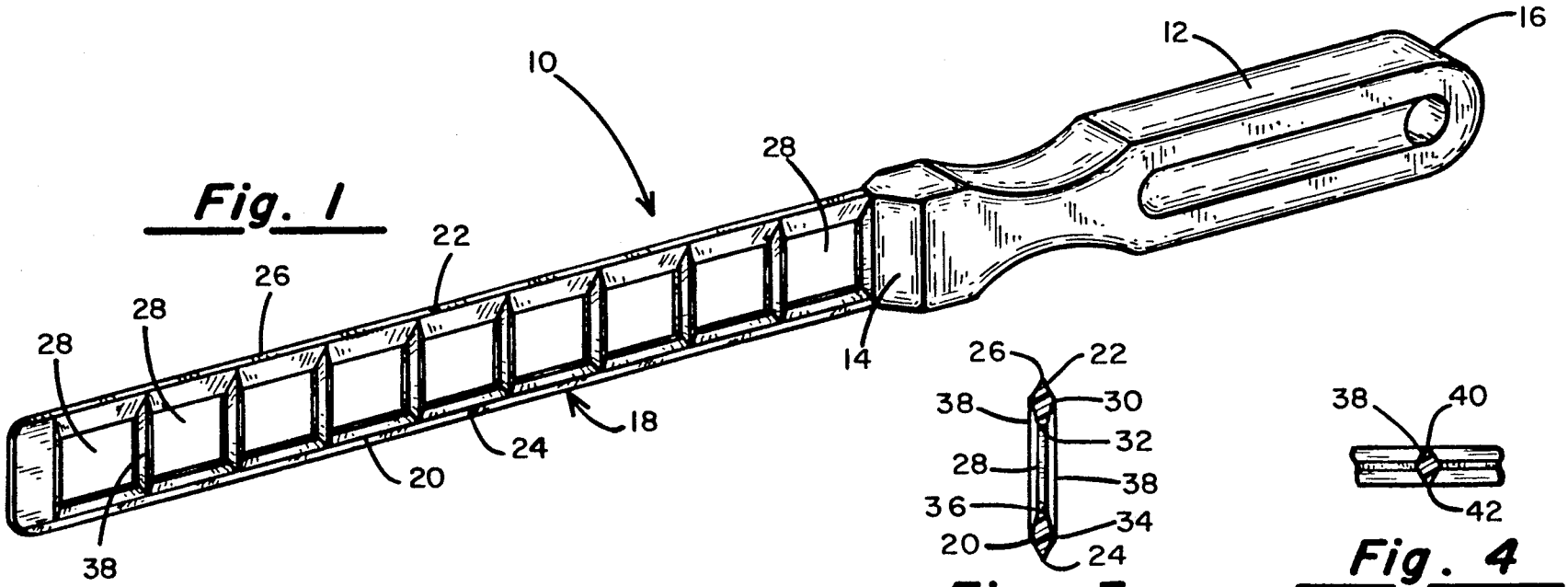
Fig. 1
Fig. 4
Fig. 3
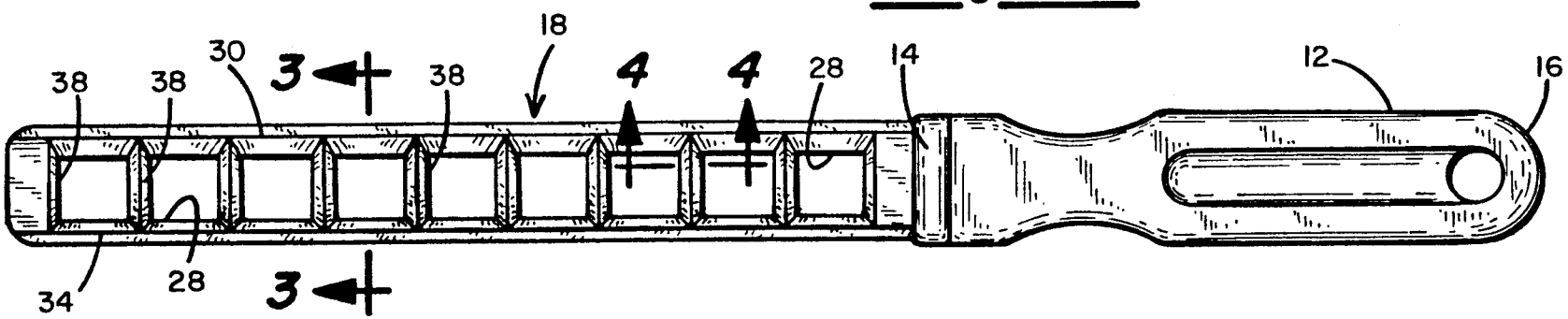
Fig. 2

SLICING KNIFE WITH NON-STICK BLADE

BACKGROUND OF THE INVENTION

I. Field of the Invention

This invention relates generally to cutting implements, and more particularly to a knife especially designed for slicing thin slices of cheese, meat and the like from a block of same.

II. Discussion of the Prior Art

A variety of kitchen utensils have been devised for facilitating the slicing of food items such as cheese from a block of cheese. One popular cheese cutting implement for home use comprises a handle having a bifurcated arms supporting a transversely extending guide roller and a cutting wire therebetween. In use, the roller is brought into contact with an edge of the block of cheese and the wire is then made to pass through the cheese by pressing downward on the handle and rolling the roller along the edge of the block as a reference. This arrangement suffers from a number of drawbacks. First of all, after a limited period of use, the wire tends to deform so as to no longer be taut. As it is brought through the cheese, a wavy surface pattern results on the slices. Also, it is difficult to bring the wire all the way through the cheese block so the user usually ends up breaking off the cheese near the bottom surface on which it is resting, leaving a jagged, irregular edge on the slice, detracting from its appearance.

When an attempt is made to use a regular paring knife or butcher's knife in cutting through some cheeses, the cheese adheres to the broad flat surfaces of the blade, making it difficult to pass the blade of the knife through the block.

French Patent 2,537,037 to Rubalec describes a cheese knife having a blade with a single cutting edge and a series of openings are separated by links of reduced thickness. Because of the openwork blade employed, it may be used to cut pastry materials, including cheese, in a neat manner without sticking. The present invention is deemed to be an improvement over the device shown in the French Patent 2,537,037. Because of the unique design of the blade employed, it contacts the material being sliced only along a series of fine line surfaces, making it possible to severe very soft, sticky cheeses as well as hard cheeses.

It is accordingly the principal object of the present invention to provide an improved knife which can be used to readily severe slices of various food items of a desired thickness from a block of same.

SUMMARY OF THE INVENTION

In achieving the principal object, the knife of the present invention comprises a handle configured to be readily gripped and projecting from the handle is an elongated, generally rectangular blade with opposed side edges being beveled to create cutting edges along each side of the blade. The blade has a plurality of regularly, longitudinally, spaced apertures or indentations extending into its thickness between the opposed side edges. The blade material is tapered inwardly in progressing from the widest point of the opposed knife edges toward the regularly spaced apertures or indentations. It also includes a plurality of transversely extending ribs positioned at regular intervals between adjacent apertures along the length of the blade where the ribs have a rhombic cross-section. Because of the fact that the blade includes the inwardly sloping feature and the plurality of apertures/indentations separated by transversely extending ribs, as one or the other of two knife edges are pressed downward through a block of cheese, the block on one side and the slice on the other only contacts the blade along a series of spaced lines of contact corresponding to the corners of the ribs of rhombic cross-section. This allows the knife to readily glide through the block of cheese without sticking.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which:

FIG. 1 is a perspective view of the slicing knife of the present invention;

FIG. 2 is a side elevation of the knife of FIG. 1;

FIG. 3 is a cross-sectional view taken along the line 3—3 in FIG. 2; and FIG. 4 is a cross-sectional view taken along the line 4—4 in FIG. 2.

DESCRIPTION OF THE PREFERRED EMBODIMENT

Referring first to FIG. 1, there is indicated generally by numeral 10 the food slicing knife in accordance with the present invention. It will be described as a cheese slicing knife, but it may be used in slicing other food items, such as frosted cakes, which may tend to stick to conventional knife blades. It is seen to include a handle member 12 appropriately shaped for gripping in the hand of the user, the handle having first and second ends 14 and 16. Projecting outwardly from the first end 14 of the handle 12 is a blade member 18. It is preferably formed from a metal such as stainless steel or aluminum, although certain plastics may also be used depending upon the consistency (hardness) of the cheese to be cut.

The blade 18 is generally rectangular and has opposed side edges 20 and 22 which are beveled to a wedge or knife edge as at 24 and 26. The angle of bevel is preferably about 30 degrees and at its widest point, the blade may be about 0.075 inch in thickness. Formed through the thickness dimension of the blade are a plurality of longitudinally spaced apertures 28 which are wholly contained between the side edges 20 and 22. They are illustrated as being rectangular, but circular or oval shaped apertures may be used. Moreover, it is not necessary that they pass completely through the blade. Indentations on opposite side surfaces of the blade to create longitudinally, spaced zones of reduced thickness, e.g., 0.020 inch, yields satisfactory results. As is illustrated, the apertures/indentations are non-symmetrically located relative to the opposed edges of the blade..

FIG. 3 is a cross-sectional view taken along the line 3—3 in FIG. 2. As shown in FIG. 3, the upper edge 22 of the blade 18 tapers from its widest point identified by numeral 30 to the knife edge 26. Also, the blade tapers from the widest point 30 inwardly on both side surfaces of the blade to a lesser dimension at the edge 32 where the aperture 28 begins. Likewise, the lower edge 20 of the blade has its widest point identified by numeral 34 and it tapers from there downward to the knife edge 24. The blade material is also tapered inwardly from its widest point 34 to a predetermined minimum at 36 where the aperture 28 begins.

Referring to FIGS. 2 and 4, it can be seen that positioned between each of the apertures 28 is a transversely extending rib as at 38. These ribs are integrally formed with the blade 18 and, as seen in FIG. 4, have a cross-section which is rhombic in shape. Thus, the diagonal corners 40 and 42 extend laterally outward from the opposed sides of the blade and as the knife is pressed through a block of cheese, the block and the slice being severed will only contact the blade along the plural lines corresponding to the corners 40 and 42 of the ribs 38. Because the knife only contacts the cheese along these plural lines, and because the blade tapers inwardly from its widest points 30 and 34 to the edge of the apertures 28, the cheese will not adhere to the blade surface and thus make it difficult to press the knife blade on through the block to severe a complete slice from it.

In that the novelty of the present invention resides primarily in the blade portion of the knife, a variety of handle designs may be employed without departing from the scope of the invention. While FIGS. 1 and 2 show an integrally molded configuration of handle and blade, those skilled in the art can appreciate can various handle designs and modes of attachment may be employed. For example, a wooden handle may be applied by sandwiching an extension of the blade between two pieces of wood and then holding them in place using transversely extending rivets or the like. The handle may be offset vertically from the midline axis of the blade to prevent the user's knuckles from contacting the table or cutting board as the knife blade is made to pass completely through the block. Alternatively, the blade 18 can be positioned between the ends of a bifurcated (Y-shaped) handle.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A slicing knife for cutting thin slices of a food item from a block thereof, comprising:

(a) a handle member; and (b) a thin, elongated blade formed from a blade material of a predetermined thickness and affixed to said handle member, said blade being generally rectangular with opposed side edges which are beveled at a predetermined angle from said predetermined thickness to a knife edge, said blade having a single aligned row of a plurality of longitudinally spaced apertures formed into the blade material between said opposed side edges, said blade material being tapered inwardly in progressing from said opposed side edges toward said longitudinally spaced apertures, said blade including a transversely extending rib disposed between adjacent ones of said apertures at intervals along the length of said blade, said ribs having a generally rhombic cross-section defining a pair of transversely extending fine line edges on opposed sides of said blade, whereby when one of said side edges of said blade is pressed through said block in slicing the food item, the blade engages the block and a severed slice only along said fine line edges and said knife edge.

2. The slicing knife as in claim 1 wherein said apertures are rectangular in shape.

3. The slicing knife as in claim 2 wherein said rectangular apertures are located closer to one of said opposed side edges than to the other.

4. The slicing knife as in claim 1 wherein said predetermined thickness of said blade is about 0.075 inch.

* * * * *